United States Patent [19]

Barford

[11] 4,024,587

[45] May 24, 1977

[54] HELMET CONVERSION KIT SAFETY HELMET

[75] Inventor: John Cowper Barford, Toronto, Canada

[73] Assignee: Griffin Products Incorporated, Bramalea, Canada

[22] Filed: Mar. 1, 1976

[21] Appl. No.: 662,409

[30] Foreign Application Priority Data

Mar. 3, 1975 United Kingdom ..... 08776/75

[52] U.S. Cl. ..... 2/424

[51] Int. Cl.[2] ..... A42B 1/08

[58] Field of Search ..... 2/410, 424, 425

[56] References Cited

UNITED STATES PATENTS

| | | | |
|---|---|---|---|
| 2,777,127 | 1/1957 | Marietta | 2/424 |
| 2,908,911 | 10/1959 | Sowle | 2/424 X |
| 3,423,758 | 1/1969 | Heacox | 2/424 |
| 3,478,365 | 11/1969 | Varga | 2/424 |
| 3,548,410 | 12/1970 | Parker | 2/424 |
| 3,588,914 | 6/1971 | Ihnat | 2/425 X |
| 3,624,663 | 11/1971 | Jones | 2/424 |
| 3,628,191 | 12/1971 | Douglas | 2/425 X |

FOREIGN PATENTS OR APPLICATIONS

| | | | |
|---|---|---|---|
| 640,428 | 5/1962 | Canada | 2/424 |

*Primary Examiner*—Alfred R. Guest
*Attorney, Agent, or Firm*—Robert G. Hirons

[57] ABSTRACT

A full face safety helmet comprises a helmet portion, of the usual, generally part spherical form adapted to cover and protect the wearer's skull, and a chin guard member in the form of a closed loop of impact resistant material. The chin guard member has inwardly inclined side walls, and the bottom of the helmet is received in these side walls as an interference, cone-and-wedge fit. The chin guard member also has protruberances on its side walls adapted to engage the lower forward edge of the helmet portion, to protect the wearer against blows on the front of the chin guard member. The helmet portion and chin guard member are releasably secured together, so that the helmet can if desired be used as a full coverage safety helmet, without the chin guard.

10 Claims, 7 Drawing Figures

FIG.1
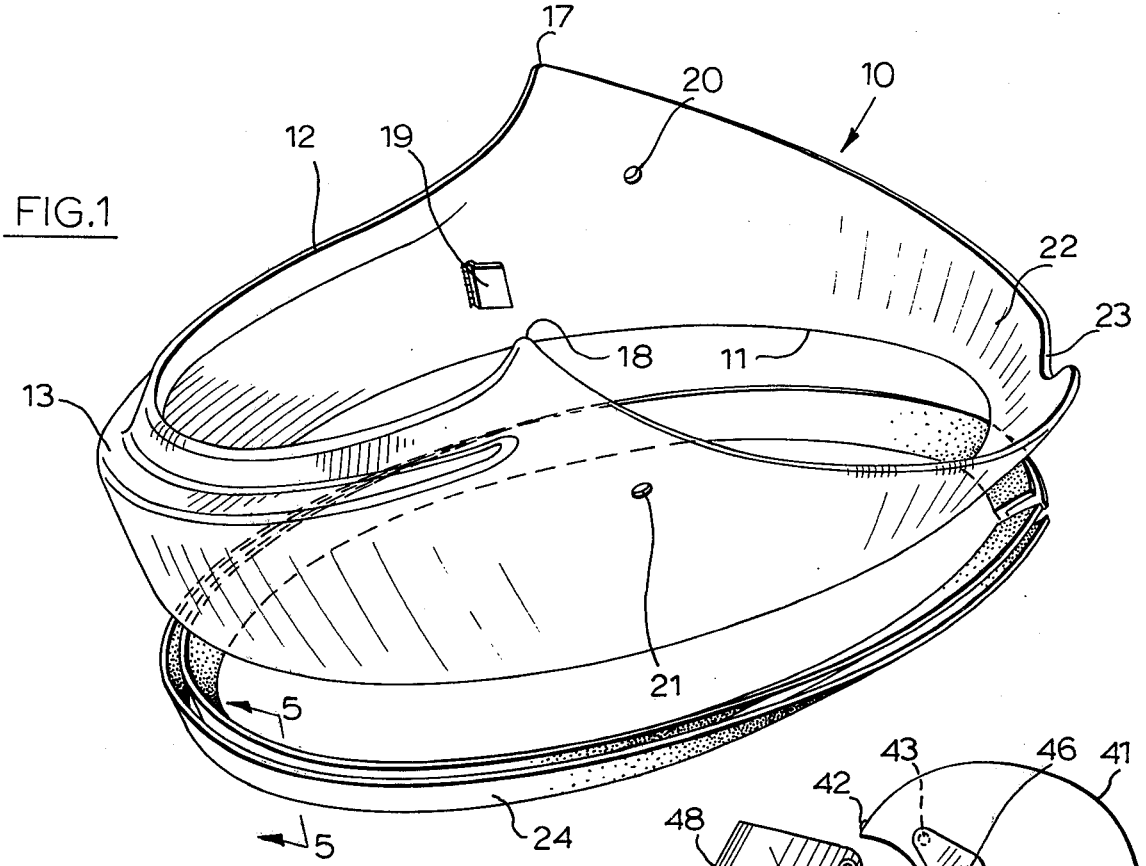
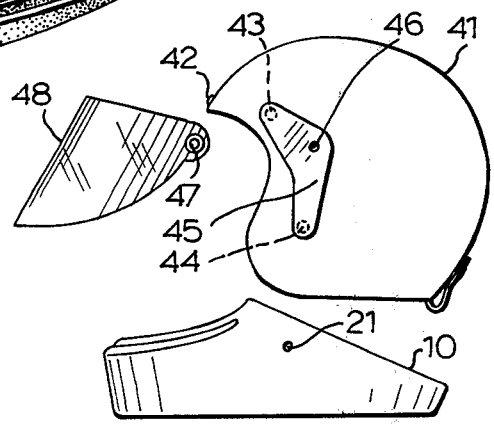
FIG.7
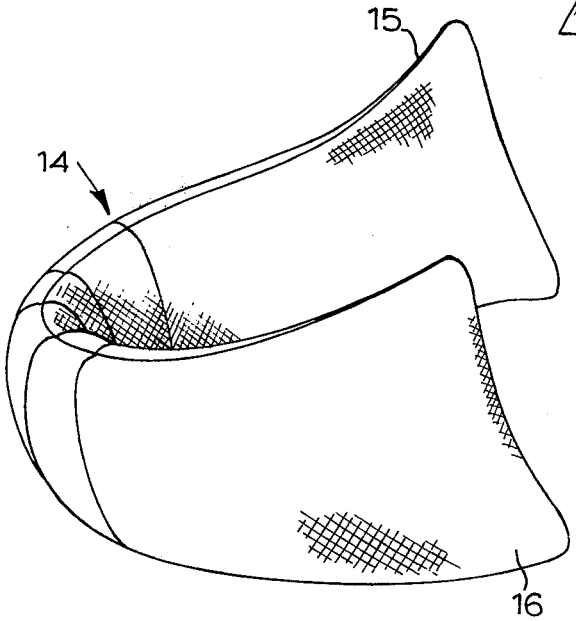
FIG.2

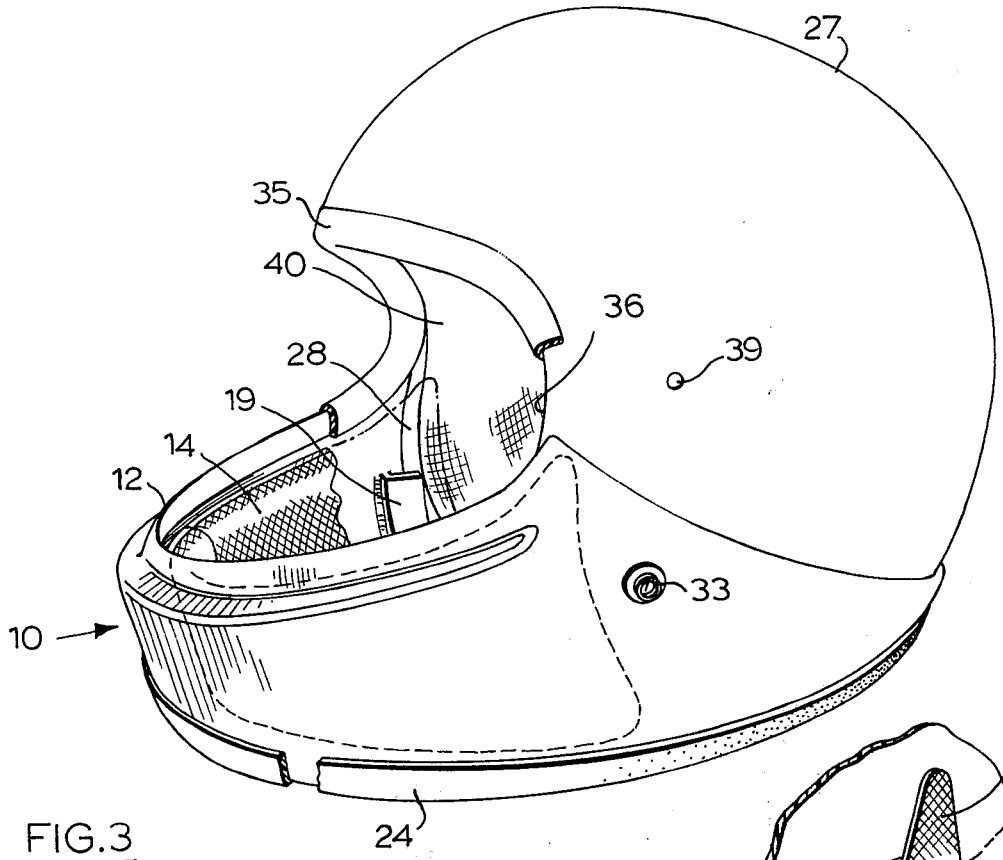
FIG.3
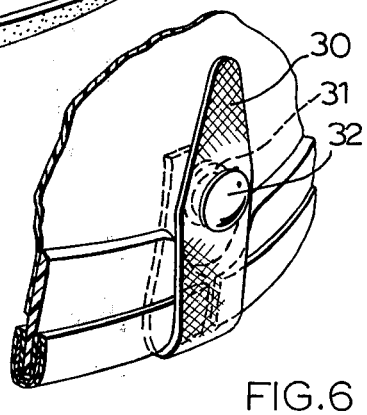
FIG.6
FIG.4
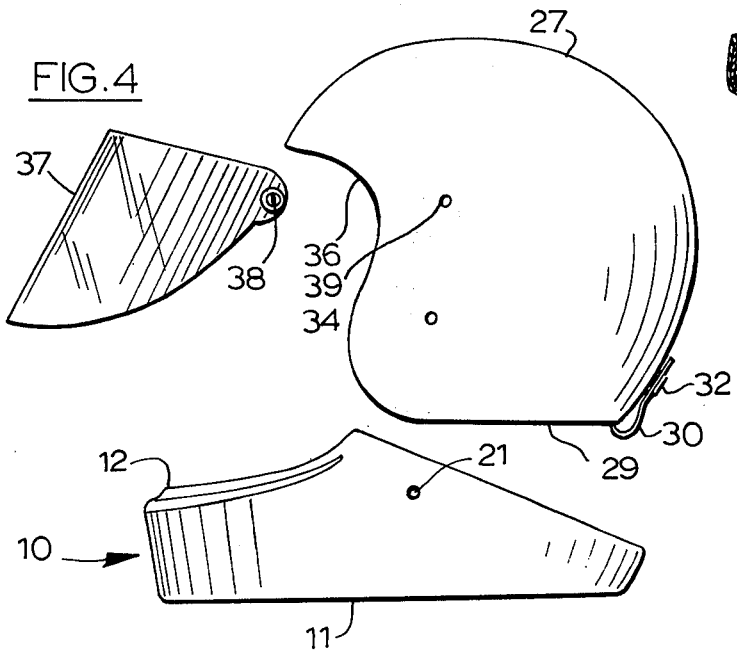
FIG.5
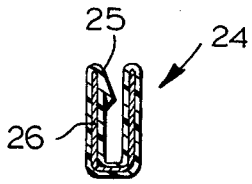

HELMET CONVERSION KIT SAFETY HELMET

FIELD OF THE INVENTION

This invention relates to safety helmets, of the type worn by motorcycle riders, snowmobile riders, automobile race drivers and the like. More particularly, the invention relates to a helmet and component parts thereof which can be assembled to provide either a full coverage type safety helmet of a full face safety helmet. The invention also relates to the full coverage safety helmet and the full face safety helmet so formed, and to a component kit useful for converting a full coverage safety helmet into a full face safety helmet.

BRIEF DESCRIPTION OF THE PRIOR ART

Until recently, safety helmets in most common use were of the full coverage type, comprised of a part spherical helmet adapted to terminate at the level of the wearer's forehead and extend around to the base of the skull, the side parts being adapted to cover the wearer's ears and part of his cheek bones. The full coverage helmet is provided normally with straps which are fastened under the wearer's chin. This type of helmet affords full coverage of and protection for the skull, but leaves the wearer's face and chin substantially unprotected against impacts, except to a small extent as provided by a pivotally attached visor.

More recently there has been introduced the full face safety helmet, which in addition to the helmet portion found on a full coverage helmet, also has a rigid chin guard part projecting from the lower part of the helmet and extending forwardly in front of the wearer's chin, thereby defining, along with the front of the helmet, a face aperture. A visor is commonly pivotally attached to the full face safety helmet, to cover the face aperture. The full face safety helmet affords impact protection to the wearer's chin and lower face.

SUMMARY OF THE INVENTION

The present invention provides a means for converting a full coverage helmet into a full face helmet, and components for use therein, whereby the owner of a full coverage helmet can effect such conversion himself without requiring operations which need to be carried out in a work shop or factory. The invention also provides a full face safety helmet which is simply convertible to a full coverage safety helmet and vice versa, but which in addition offers superior performance in practice, in protecting the wearer's head from impacts from substantially all directions.

Thus according to the present invention, there is provided a chin guard member adapted for cooperation with the lower part of a full coverage safety helmet to form in conjunction therewith a full face safety helmet, said chin guard member comprising a closed loop of impact resistant material and having side walls inclined inwardly in a downwards direction, the chin guard member being dimensioned so as to receive the lower part of a full coverage safety helmet within said closed loop as an interference fit, and having a pair of opposed inwardly extending protruberances on the side walls thereof adapted to engage the lower forward edge of said full coverage safety helmet when assembled therewith.

According to a second aspect of the present invention, there is provided a full face safety helmet comprising a helmet portion adapted to cover and protect the skull of the wearer and a rigid chin guard member adapted to extend in front of and protect the wearer's chin, the helmet portion and the chin guard member defining between them a face aperture, the chin guard member being removably assembled with the helmet portion, the chin guard member comprising a closed loop of impact resistant material and having side walls inclined inwardly in a downwards direction, and receiving the lower part of the helmet part within said closed loop as an interference fit, the chin guard member also having a pair of opposed inwardly extending protruberances on the side walls thereof engaging the lower forward edge of the helmet portion.

DESCRIPTION OF THE PREFERRED EMBODIMENTS

In one preferred form of the invention, there is additionally provided in the chin guard member an energy absorbing pad, adapted to be received within the forward part of the chin guard member and be positioned between the chin guard member and the wearer's chin, to provide added impact protection. In another preferred form of the invention, there is provided a first grip edging strip adapted to fit over the upper edge of the chin guard member and the upper front edge of the full face safety helmet, so as to extend in a single piece around the periphery of the face aperture and assist in retaining the chin guard member and the full face safety helmet in assembled relationship. There is also preferably provided a second grip edging strip, adapted to fit around the lower edge of the chin guard member and the lower rear edge of the helmet, to assist in retaining them in assembled relationship.

There may also be provided a visor, adapted to be pivotally mounted on either the chin guard member or the helmet, for pivotal movement of the visor into a position in front of the face aperture.

BRIEF REFERENCE TO THE DRAWINGS

A preferred embodiment of the invention will now be described with reference to the accompanying drawings, in which:

FIG. 1 is an exploded perspective view of a chin guard member and associated second (bottom) grip edging strip;

FIG. 2 is a perspective view of an energy absorbing pad for use with the chin guard member of FIG. 1;

FIG. 3 is a perspective view, somewhat diagrammatic and partly cut away, of an assembled full protection safety helmet and chin guard member according to the invention;

FIG. 4 is an exploded diagrammatic view of a chin guard member, full protection safety helmet and visor assembly according to the present invention:

FIG. 5 is a cross sectional view of a grip edging strip for use in the assembly of the present invention, e.g. along the line 5—5 of FIG. 1;

FIG. 6 is a detail of the lower rear portion of the assembled full protection helmet of FIG. 3;

FIG. 7 is a view similar to FIG. 4, but of an alternative embodiment.

DETAILED DESCRIPTION OF THE ILLUSTRATED EMBODIMENT

With reference to FIG. 1, the chin guard member 10 is a closed loop of impact resistant plastic material, namely polycarbonate. The lower edge 11 of the chin guard member 10 is generally planar, and defines a generally elliptical lower aperture, of a size sufficient that the chin guard member 10 can easily be slipped over the wearer's head. As illustrated, all of the side walls are inwardly inclined in a downwards direction. The upper front edge 12 is formed on the inner end of an inwardly extending front lateral rim 13, so that the front portion of the chin guard member 10 has an internal cavity-type formation. This cavity formation is adapted to receive therein the energy absorbing pad 14, as illustrated in FIG. 2. The pad 14 is suitably sized, to fit within the cavity formation at the front of the chin guard member 10, and to extend peripherally around inside the front part of the chin guard member 10. The pad 14 is provided with slightly flared end portions 15, 16 which complement the shape of the walls of the chin guard member 10. The configuration of the upper edge 12 of the forward portion of the chin guard member 10 is designed so as to cooperate with the lower front edge of the helmet to which the chin guard member 10 is to be attached, to define a continuous edge of a face aperture in the finished helmet combination. Thus, the front upper edge 12 terminates in peaks 17, 18 as illustrated. The peaks 17, 18 are located approximately midway between the front and the back of the chin guard member 10.

A short distance forwardly of the peaks 17, 18 the chin guard member 10 is provided, on each of its internal surfaces, with an integral inwardly extending projection 19. The projection 19 is in the form of a bracket, presenting along with the inner sidewall a rearwardly extending slot. Slightly to the rear to the projections 19, the chin guard member 10 is provided with a pair of opposed circular apertures 20, 21. As shown, the rear portion 22 of the walls of the chin guard member 10 is of less height than the other parts of the walls, and is provided with a recess 23 in its upper surface. The recess is adapted to receive a releasable strap 30, attached to the inside of the helmet, which can surround the rear wall 22 and be fastened to a stud on the helmet, to assist in securing the chin guard member 10 to the helmet.

A length of grip edging strip 24 is provided, of a length suitable to extend around the planar bottom elliptical edge 11 of the chin guard member 10. The strip 24 is generally U-shaped in cross section as shown in FIG. 5, and is of the type use in the automobile industry and known as "Windlace". It comprises outer layers 25 of polyvinyl chloride and an inner strip 26 of metal such as aluminum, steel wire or steel segments. The strip 24 can thus be bent to the desired shape, and squeezed so as to grip the edges to which it is applied.

With reference to FIG. 3, there is shown the chin guard member 10 of FIG. 1 assembled with a full coverage safety helmet 27, the whole assembly thereby comprising a full face safety helmet. The helmet portion 27 is received in the rear portion of the chin guard member 10, and is an interference fit therein, the fit being of the cone and wedge type, since the helmet 27 is generally part spherical. The front lower edge 28 of the helmet 27, at each side, engages one of the projections 19 on the chin guard member 10. The lower rear edge 29 of the helmet 27 largely coincides with the rear part of the lower edge 11 of the chin guard member 10. The edge gripping strip 24 is applied around the lower edge 11 of the chin guard member and, at the rear part, around the lower rear edge 29 of the helmet 27 so as to assist in securing these parts together. Further attachment is provided by a strap 30 attached at one end to the inside of the helmet 27 by a bolt 31. The strap has a stud fastener 32 near its other end. The strap extends around the rear portion 22 and recess 23 of the walls of the chin guard member 10, to be fastened at its other end by stud fastener 32 onto a complementary formation carried by bolt 31 on the outside of the helmet portion 27.

The chin guard member 10 is additionally releasably secured to the helmet portion 27 by a screw 33 passing through an aperture 34 in the helmet portion 37 and the aperture 21 on the chin guard member. The screw 33 is received in a complementarily screw threaded stud projecting into apertures 21, 34 from inside the helmet 37. Similar screw and threaded stud securing means are provided at the other side of the assembly, for aperture 20, etc..

As shown in FIG. 3, the full face safety helmet includes another grip edging strip 35, applied around the face aperture, i.e. over edge 12 of the chin guard member 10, and around forward upper edge 36 of the helmet portion 27. Since one piece of grip edging strip 35 is used to go around the whole periphery of the face aperture, this grip edging strip serves to assist in retaining the helmet 27 in assembled relation with the chin guard part 10.

With reference to FIG. 4, there is there shown in exploded view a helmet portion 27, a chin guard member 10 and a visor 37. The visor 37 carries at each side a screw 38, adapted to be received in an aperture 39 on the side of the helmet. By this means, the visor 37 is pivotally attached to the helmet 27 at each side.

As shown in FIG. 3, the skull covering portion of the helmet 27 is provided with an inner lining 40 of soft, energy absorbing material.

To assemble the parts to make the full face helmet shown in FIG. 3, the helmet portion 27 is fitted inside chin guard member 10, and pressed into position until the front edge 28 of the helmet portion 27 abuts against the protruberances 19 on the inside surface of the chin guard member 10. Bottom grip edging strip 24 is applied around the bottom edges of the chin guard member 10 and helmet 27. Strap 30 as shown in FIG. 4 and FIG. 6 is secured to the outside of the helmet by means of stud 32. When assembled in this manner, aperture 34 on the helmet portion 27 is aligned with aperture 21 on the chin guard member 10. Screws 33 can be applied and fastened into the screw threaded studs in the respective apertures. Then edge strip 35 is applied, around the periphery of the face aperture, i.e. over edges 12 of the chin guard member 10 and 36 of the helmet portion 27. Then visor 37 attached by screw 38 in aperture 39.

In this means, the full protection helmet 27 has been converted into a full face helmt, without the necessity of any drillings, rivetings, cuttings or the like, and by means of operations easily performed by a safety helmet owner. It will be appreciated that the parts can be readily disassembled if desired, so as to re-convert the helmet to a full coverage type.

An alternative embodiment of the invention is illustrated in FIG. 7, comprising a means by which the owner of a conventional full coverage safety helmet can convert it to a full face safety helmet. A conventional full coverage helmet has a series of snap fasteners, totalling 5 in number, arranged at standart separations around the front edge of the helmet. These are designed to allow mounting thereon of a standard face shield. In this alternative embodiment of the invention, use is made of these existing snap fasteners in converting the existing conventional full coverage helmet to a full face helmet.

With reference to FIG. 7, there is provided a chin guard member 10 as previously described, into which the bottom portion of the full coverage helmet 41 is received as an interference, cone-and-wedge fit as before. The helmet 41 has snap fastener studs 42, 43, 44 around the front edge, in the normal way. When the chin guard member 10 is assembled with the helmet 41, the lower most stud 44 projects into aperture 21 on the side of the chin guard member 10.

A bracket 45 is provided, which on its inner surface has complementary snap fastener parts to cooperate with studs 43, 44 on the helmet. Thus on assembly, bracket 45 is snapped into place, on stud 43 and on stud 44 projecting into aperture 21 on the chin guard member 10, to hold the chin guard member 10 in position. Bracket 45 has on its outer surface another snap fastener part 46, near the center of the bracket. When the bracket is in position on the helmet 41, the fastener 46 can be used to receive a complementary fastener part 47 on a visor 48. It will of course be understood that the other side of the helmet is similarly provided with a bracket and suitable fasteners, to complete the assembly. The embodiment shown in FIG. 7 is suitably completed by applying grip edging strips to the lower surface and the face aperture as described previously. In this embodiment, the standard full coverage helmet is converted to a full face helmet by simple expedients of interfitting and fastenting using components according to the invention. No drilling, riveting, cutting or the like of the helmet needs to be done, so that the conversion can be readily performed by the helmet owner, and if desired the conversion can be readily reversed.

The assembly as shown in FIG. 3 and to some extent in FIG. 4 and FIG. 7 provides extremely good protection against impacts from substantially any direction. Blows to the skull from any direction are, of course, met by the helmet portion 27 in the normal way. Blows on the chin guard member 10 from below will serve merely to drive the helmet portion 27 and chin guard portion 10 into closer relationship, and will be resisted by the interference nature of the fit between these components. Blows to the chin guard 10 from in front are taken by the cooperation of protruberances 19 with the lower front edge 28 of the helmet portion 27. Thus, blows from any direction are accounted for by the assembly of the invention, to afford protection to the wearer of the helmet in all cases.

The provision of the chin guard member 10 as a continuous loop formation substantially enhances the rigidity of the final assembly, making it much superior in performance to a discontinuous chin guard member merely attached to the front of a safety helmet. This arrangement substantially enhances the ability of the assembled full face safety helmet to protect the wearer from impacts from below. The chin guard member of the present invention can be readily and economically manufactured as a one-piece molding of plastics material.

It is desirable to make the chin guard member of the same material as the helmet portion 27. Thus, plastics materials commonly used for safety helmets, and therefore useful in the present invention, include polycarbonates, fibreglass, high density polyethylene and ABS resins. Chin guard members according to the present invention can if desire by provided in a variety of different sizes, so as to match different sizes of full protection safety helmets currently available.

I claim:

1. A chin guard member for cooperation with the lower part of a full coverage safety helmet;

said chin guard member comprising a closed loop of impact resistant material;

the chin guard member having side walls with inner faces inclined inwardly in a downwards direction at least at the rear portion thereof, and adapted to receive as an interference fit therebetween the lower part of a full coverage safety helmet;

the chin guard member having on the inner faces of the side walls inwardly extending protruberances adapted to engage lower forward edges of a full coverage safety helmet when in interference fit between said side walls;

means on the chin guard member for securing it to a full face safety helmet.

2. The chin guard member of claim 1 having a bottom edge which is generally elliptical as viewed in underneath plan, and lies in a transverse plane.

3. The chin guard member of claim 1 having:

a front side wall inclined inwardly in a downward direction;

an inwardly extending lateral rim on the upper edge of said front side wall;

an energy absorbing pad secured in the cavity formed between the front side wall and the lateral rim thereof;

said energy absorbing pad extending around said front side wall and being adapted to be positioned forwardly of the wearer's chin when the chin guard member is worn secured to a full coverage safety helmet.

4. A full face safety helmet comprising:

a helmet portion adapted to cover and protect the skull of the wearer;

a rigid chin guard member secured to the helmet portion and adapted to extend in front of and protect the wearer's chin;

the helmet portion and chin guard member defining between them a face aperture;

the helmet portion having lower rear walls inclined inwardly in a downwards direction;

the chin guard member comprising a closed loop of impact resistant material and having side walls with inner faces inclined inwardly in a downwards direction, and adapted to receive the inclined lower walls of the helmet portion as an interference fit therebetween;

the chin guard member also having opposed inwardly extending protruberances on the side walls thereof engaging the lower forward edge of the helmet portion.

5. The safety helmet of claim 4 wherein the chin guard member is releasably secured to the helmet portion.

6. The safety helmet of claim 4 wherein the chin guard member includes an energy absorbing pad received within the forward part thereof to be positioned between the chin guard member and the wearer's chin.

7. The safety helmet of claim 6 also including a first grip edging strip adapted to fit over the forward upper edge of the chin guard member and the upper front edge of the helmet portion, to extend around the periphery of the face aperture.

8. The safety helmet of claim 7 also including a second grip edging strip adapted to fit around the lower edge of the chin guard member and the lower rear edge of the helmet portion.

9. The safety helmet of claim 5, also comprising a pair of brackets removably secured one to each side of the helmet portion, one fastening means of each said bracket cooperating with the chin guard member and the helmet portion so as to secure the chin guard member to the helmet portion, each of said brackets being provided with external fastening means for removably securing thereto a visor.

10. Means for converting a full coverage safety helmet to a full face safety helmet, said means comprising:

a chin guard member comprising a closed loop of impact resistant materials;

the chin guard member having side walls with inner faces inclined downwardly in a downwards direction at least at the rear portion thereof, and adapted to receive as an interference fit therebetween the lower part of a full coverage safety helmet;

the chin guard member having on the inner faces of the side walls inwardly extending protruberances adapted to engage lower forward edges of a full coverage safety helmet when in interference fit between said side walls;

a pair of releaseable brackets, each said bracket having inwardly presented fastening means for cooperation with eomplementary fastening means on the helmet portion, and outwardly presented fastening means for cooperation with complementary fastening means on a visor portion;

the cooperation of at least on of the fastening means on the releasable bracket with a complementary fastening means on the helmet portion comprising means for releasably securing the helmet portion to the chin guard member.

* * * * *